US006771156B2

(12) United States Patent
Chou

(10) Patent No.: US 6,771,156 B2
(45) Date of Patent: Aug. 3, 2004

(54) CHOKE

(76) Inventor: Shou-Kuen Chou, No. 6, Alley 163, Lane 256, Sec. 2, Chung Shan N. Road, Yang Mei, Taoyuan Hsien (TW)

( * ) Notice: Subject to any disclaimer, the term of this patent is extended or adjusted under 35 U.S.C. 154(b) by 1 day.

(21) Appl. No.: 10/358,559

(22) Filed: Feb. 5, 2003

(65) Prior Publication Data

US 2004/0108928 A1 Jun. 10, 2004

(30) Foreign Application Priority Data

Dec. 10, 2002 (TW) ..... 91219971 U

(51) Int. Cl.[7] ..... H01F 27/02
(52) U.S. Cl. ..... 336/83; 336/200; 336/192
(58) Field of Search ..... 336/83, 192, 200, 336/223, 232

(56) References Cited

U.S. PATENT DOCUMENTS 6,348,850 B1 * 2/2002 Kimura et al. ..... 336/200
6,392,523 B1 * 5/2002 Tsunemi ..... 336/192
6,449,830 B1 * 9/2002 Amada et al. ..... 29/605
6,522,230 B2 * 2/2003 Hanato et al. ..... 336/83
6,535,095 B2 * 3/2003 Aoki et al. ..... 336/83
2003/0071704 A1 * 4/2003 Toi et al. ..... 336/83

* cited by examiner

*Primary Examiner*—Anh Mai
(74) *Attorney, Agent, or Firm*—Law Offices of John Chupa & Associates, P.C.

(57) ABSTRACT

A choke includes a base body, a plating layer and at least a coiled wire. The base body is a solid conductor with a cylindrical reel between an upper plate and a base bottom. The base bottom at two lateral sides thereof extends downward a base foot respectively and at least one of the base feet at an inner side thereof close to a support foot, which extends downward. A wire groove is formed between the base foot and the support foot. The plating layer is a conductor and plated on at least a pair of corners formed by the base feet, the support feet and the wire groove. The coiled wire is a metal wire with an outer insulation, which is wound up the reel with two wire ends thereof being connected to the plating layer.

3 Claims, 2 Drawing Sheets

CHOKE

BACKGROUND OF THE INVENTION

1. Field of the Invention

The present invention relates to a choke, and particularly to a choke with a function of being wound up automatically.

2. Description of Related Art

The choke is an electronic passive component having been used for years and the principle of actuation for the choke is that a coil formed by an annular iron core is coiled with a copper wire and a magnetic field can be generated as soon as the current passes through the coiled copper wire. Thus, the choke is able to being used in a circuit board as, for instance, a filter for direct current.

The conventional choke has a structure that the coiled wire is wound up along the surface of the annular iron core and, mostly, the winding wire job is done manually with low output and unsteady quality. Although the manufacture has developed an automatic winding machine to process the coil of the annular iron core with low labor cost, it is costly with low fabrication efficiency so that the coiled wire made with winding manually is still much better than that done with automatic machine. Besides, in order to be inserted to the circuit board so as to form a close circuit, the choke usually extends connecting pins for being able to engage with locating holes made in advance in the circuit board.

However, a tedious job including bending the conductive plates, wrapping the base and joining the coil to the circuit has to be done in order to provide the connecting pins but the preceding work becomes different in case of the choke having a very small size.

Besides, the conventional choke is made individually, that is, each base body has an independent coiled wire such that it is necessary to insert two or more chokes onto the circuit board respectively for a stronger functional need. As a result, it increases the difficulty of the circuit board design.

On the other hand, the surface treatment technique has more advanced development and the plasma treatment technique applied to the surface of an electronic component is getting mature so that the surface formed with mixing silver material provides a property of electricity conduction. Hence, the traditional mode of the choke being inserted to the circuit board by means of connecting pins is not an only way have to be done.

The present inventor has endeavored in developing electronic component, especially the choke for years and has been granted a Taiwanese Utility Model No. 178515 (corresponding Chinese Utility Model No. 00257206.0). In order to overcome the deficiency of the traditional choke, the present invention has been disclosed with a new structure with regard to the choke.

SUMMARY OF THE INVENTION

A primary object of the present invention is to provide a choke includes a base body, a plating layer and at least a coiled wire. The base body is a solid conductor with a cylindrical reel between an upper plate and a base bottom. The base bottom at two lateral sides thereof extends downward a base foot respectively and at least one of the base feet at an inner side thereof close to a support foot, which extends downward. A wire groove is formed between the base foot and the support foot. The plating layer is a conductor and plated,on at least a pair of corners formed by the base feet, the support feet and the wire groove. The coiled wire is a metal wire with an outer insulation, which is wound up the reel with two wire ends thereof being connected to the plating layer.

BRIEF DESCRIPTION OF THE DRAWINGS

The present invention can be more fully understood by reference to the following description and accompanying drawings, in which.

DETAILED DESCRIPTION OF THE PREFERRED EMBODIMENT

Figure 1:
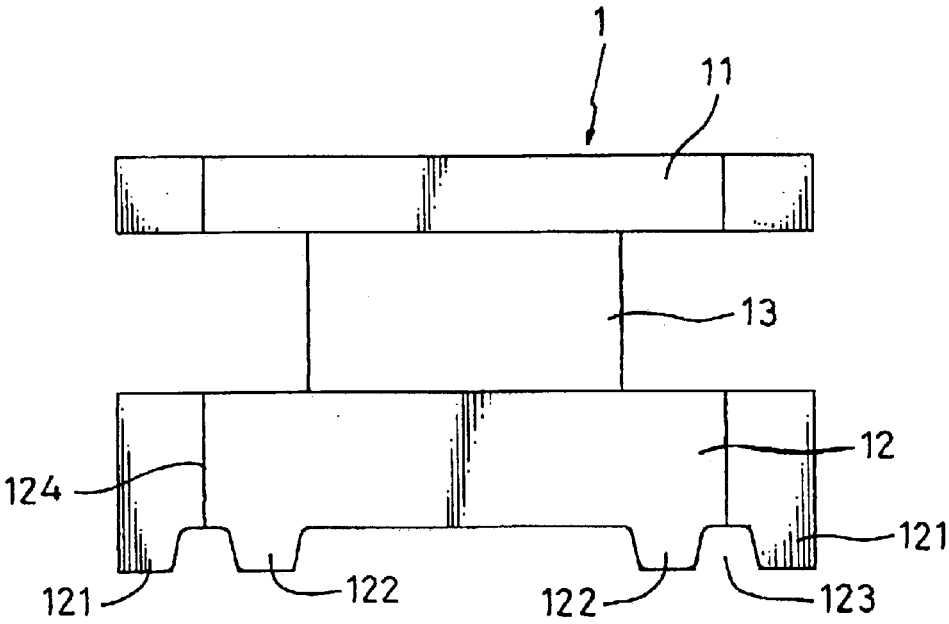
FIG. 1 is a front view of a base in a choke according to the present invention.
Figure 2:
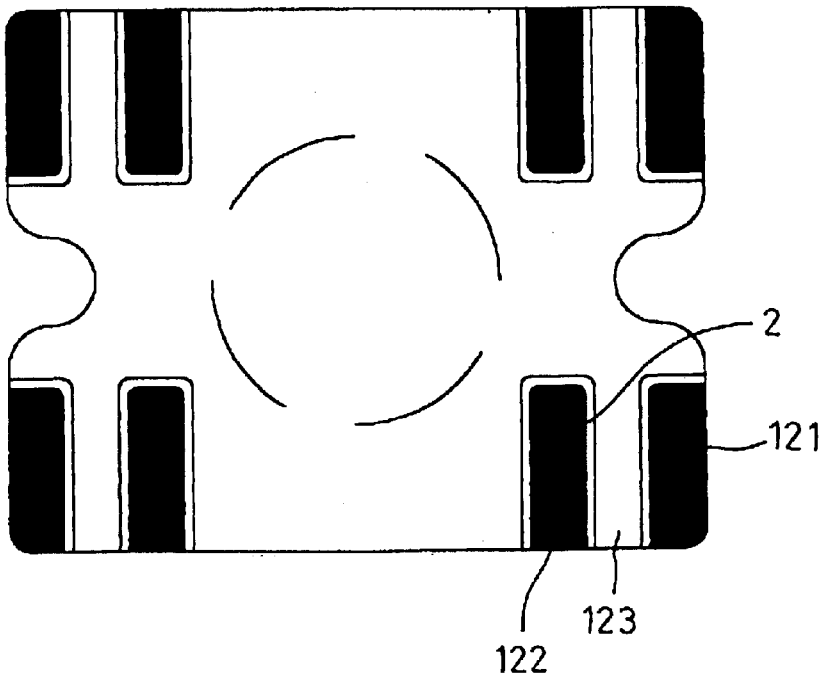
FIG. 2 is a bottom view of the base shown in FIG. 1.

Referring to FIGS. 1 to 4, basically, a choke according to the present invention includes a base body 1, a plating layer 2 and a coiled wire 3.

Wherein, the base body 1 is solid made of, for instance, sintered iron powder (powder metallurgy) in a shape of rectangle as a unit. The embodiment shown in the figures provides the base body 1 having a cylindrical reel 13 between a top plate 11 and a base bottom 12 for being wound up with the coiled wire 3. The base bottom 12 at two lateral sides thereof extending downward a base foot 121 respectively and a support foot 122, which extends downward from the base bottom 12, is disposed next to the inner side of one of the base feet 121 or to inner sides of both of the base feet 121 so that a wire groove is formed between the respective support foot 122 and the respective base foot 121 respectively for receiving and locating both wire ends 31 of the coiled wire 3. Besides, the wire groove 123 at the front and the rear edges has a slit 124 respectively extending to the top surface of the base bottom 12 as passages for coiled wire 3.

Figure 3:
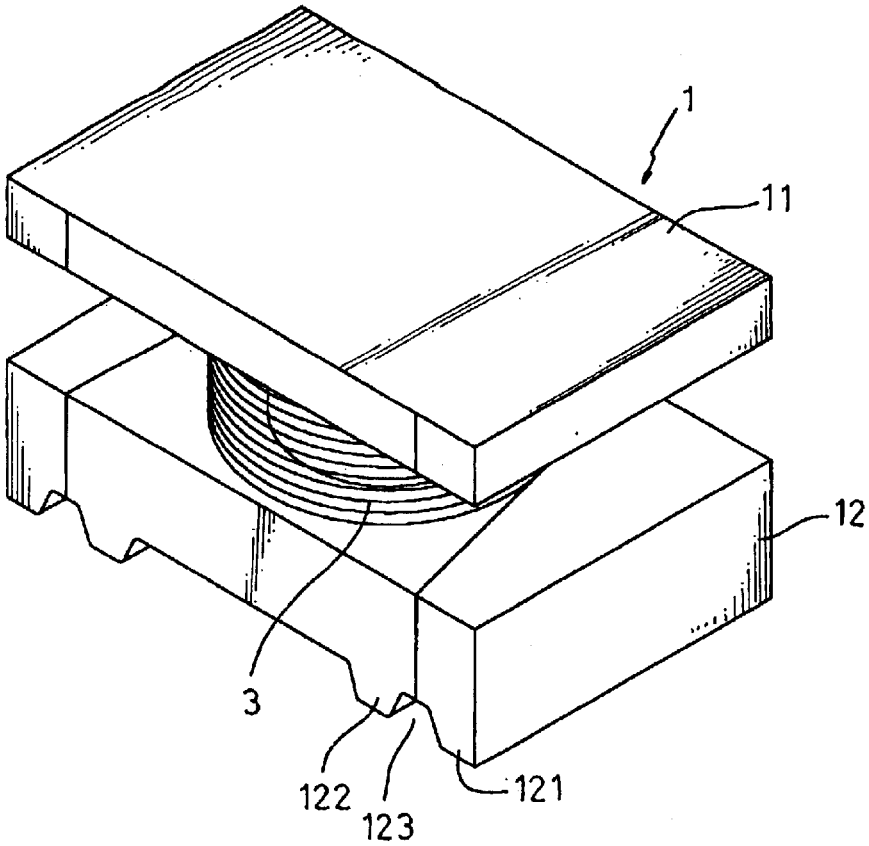
FIG. 3 is a perspective view illustrating a chock of the present invention after being coiled.
Figure 4:
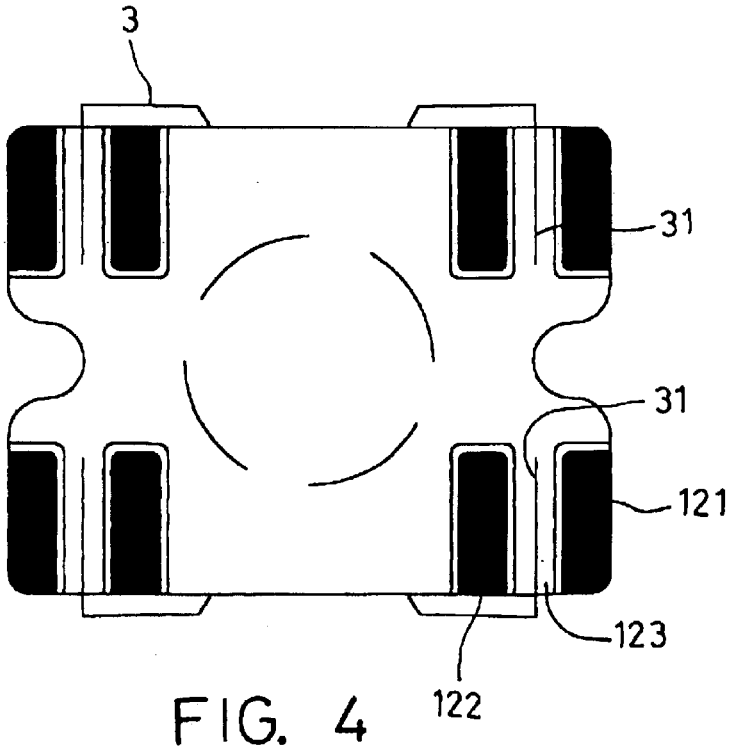
FIG. 4 is a bottom view of the base after being coiled.

Wherein, in case of a support foot 122 being provided between the two base feet 121, the wire groove 123 at the front and rear edges is possible for the two wire ends 31 to be located and form a single choke. In case of two support feet 122 being provided between the two base feet 121 as shown in FIGS. 1 and 3, two coiled wires 3 with two sets of wire ends can be received so as to form two chokes disposed side by side.

The plating layer 2, which is made of metallic material with a low melting point such as silver or tin, is plated over the base feet 121 of the base bottom 12, all corners of the support feet 122 and wire grooves 123 are formed with a thin layer as a close circuit with the circuit board. The plating layer 2 on all corners is separated from each other to form positive and negative poles.

In practice, the choke of the present invention can be fixedly attached to an electronic component via plating layer 2 at the bottom of the base 1 melting joining the silver plasma treated surface of the electronic component by way of heat of low temperature from such as a hair dryer to avoid the trouble resulting from the conventional pin joining.

It is appreciated that the choke according to the present invention can provide a function of automatic coiling done by automatic machinery because the reel is cylindrical and coiled wire can be wound up on the surface of the reel directly to reduce the rely of labor. Further, the choke of the present invention has been thinned in the thickness thereof so that it is suitable for being treated with surface melting technique (SMT) and is joined to the circuit board directly instead of pin joining. Besides, the present invention can provide single or multiple chokes to comply with different necessities and functions. Moreover, the coiled wire at the top and the bottom thereof is shielded with the upper plate and the base bottom so that it is incapable of resulting in any damager or hurt. Further, the coiled wire used is shorter and the resistance of the direct current becomes smaller so that the cost of parts and the manufacturing process can be saved substantially.

While the invention has been described with reference to a preferred embodiment thereof, it is to be understood that modifications or variations may be easily made without departing from the spirit of this invention, which is defined by the appended claims.

What is claimed is:

1. A choke, comprising a base body, being a solid conductor, having a cylindrical reel between an upper plate and a base bottom, the base bottom at two lateral sides thereof extending a base foot respectively, at least one of the base feet at an inner side thereof close to an extending support foot and a wire groove being formed between the base foot and the support foot;

a plating layer, being a conductor, being plated on at least a pair of corners formed by the base feet, the support feet and the wire groove; and at least a coiled wire, being a metal wire with an outer insulation and being wound up the reel with two wire ends thereof being connected to the plating layer.

2. The choke as defined in claim 1, wherein a slit is provided from an edge of the wire groove to a top of the base bottom for being inserted with the coiled wire.

3. The choke as defined in claim 1, wherein the base is made of sintered iron powder, the plating layer is made of silver and the coiled wire is made of enamel-covered wire.

* * * * *